US010799018B2

(12) United States Patent
Ortega

(10) Patent No.: US 10,799,018 B2
(45) Date of Patent: Oct. 13, 2020

(54) FOLDING DESK AND CHAIR APPARATUS

(71) Applicant: Rafael Ortega, Spanish Fork, UT (US)

(72) Inventor: Rafael Ortega, Spanish Fork, UT (US)

( * ) Notice: Subject to any disclaimer, the term of this patent is extended or adjusted under 35 U.S.C. 154(b) by 0 days.

(21) Appl. No.: 16/443,928

(22) Filed: Jun. 18, 2019

(65) Prior Publication Data

US 2019/0380484 A1 Dec. 19, 2019

Related U.S. Application Data

(60) Provisional application No. 62/686,918, filed on Jun. 19, 2018.

(51) Int. Cl.
*A47B 3/14* (2006.01)
*A47B 39/06* (2006.01)

(52) U.S. Cl.
CPC ..... *A47B 3/14* (2013.01); *A47B 39/06* (2013.01)

(58) Field of Classification Search
CPC ..... A47B 3/14; A47B 39/06
See application file for complete search history.

(56) References Cited

U.S. PATENT DOCUMENTS 576,803 A * 2/1897 Bernstein ..... A47B 3/14 297/156
1,367,908 A * 2/1921 Karschitz ..... A47B 3/14 297/35
1,736,531 A * 11/1929 Hodinka ..... A47B 3/14 297/55
1,856,977 A * 5/1932 Swensson ..... A47B 39/06 108/121
2,421,127 A * 5/1947 Peckham ..... A47B 3/14 297/156
2,658,562 A * 11/1953 Androsiglio ..... A47C 4/38 297/54
2,973,803 A 3/1961 Mickelson
3,650,560 A * 3/1972 Wohlk ..... A47B 3/14 297/140
4,392,685 A * 7/1983 Leonhart ..... A47C 1/14 297/119
5,007,673 A * 4/1991 Cheng ..... A47B 3/14 297/159.1
5,685,601 A * 11/1997 Corriveau ..... A47B 3/14 297/159.1
6,010,186 A 1/2000 Tsay
6,186,589 B1 2/2001 Burkamp
6,976,733 B1 12/2005 Biederman et al.
2014/0008943 A1 1/2014 Benden

* cited by examiner

*Primary Examiner* — Philip F Gabler
(74) *Attorney, Agent, or Firm* — Boudwin Intellectual Property; Daniel Boudwin

(57) ABSTRACT

A folding desk and chair apparatus. The apparatus includes a base. The base itself is defined by a pair of opposing lateral rails that are affixed together by a plurality of base supports. A chair is formed by a chair platform that is pivotally affixed to a pair of chair supports. Each chair support is pivotally connected to each opposing lateral rail. A desk comprising a desk platform is pivotally affixed to a pair of distal ends of a pair of desk supports. Each desk support is pivotally connected to each opposing lateral rail. A plurality of notches is placed on a top edge of the pair of opposing lateral rails. A desk security rod is disposed on a pair of proximal ends of the pair of desk supports. The desk security rod is sized to rest within a pair of notches of the plurality of notches.

19 Claims, 2 Drawing Sheets

FOLDING DESK AND CHAIR APPARATUS

CROSS REFERENCE TO RELATED APPLICATIONS

This application claims the benefit of U.S. Provisional Application No. 62/686,918 filed on Jun. 19, 2018. The above identified patent application is herein incorporated by reference in its entirety to provide continuity of disclosure.

BACKGROUND OF THE INVENTION

The present invention relates to a folding desk and chair apparatus. More specifically, the present invention provides a folding desk and chair apparatus that is movable between a deployed position and a stored position and is both light-weight and easy to set up and take down.

Many people utilized chairs and desks in both educational and occupational settings. Assembled chairs and desks can occupy a significant amount of space in an area. In most buildings, such as schools, homes or offices, the efficient use of space is important for not only the comfort of the occupants, but also the efficiency of the occupants. Individuals typically prefer to have decent amounts of space in which they can move around and stretch out.

Furthermore, in educational settings, children often use desks when learning new subject matter in classrooms. In addition to being uncomfortable, the desks that are utilized in classrooms are restrictive to the user while being incapable of effective storage or use. Additionally, in classrooms, space may be desired to allow the children to move around so that the children may complete schoolwork tasks, play, make art, or otherwise move around in space. Therefore, there is a defined need amongst the known art for an apparatus that provides the positive features of traditional desks and chairs with enhanced comfortability and transportability.

SUMMARY OF THE INVENTION

In view of the foregoing disadvantages inherent in the known types of chairs and desks now present in the prior art, the present invention provides a folding desk and chair apparatus wherein the same can be utilized for providing convenience for the user when utilizing a chair and a desk in a temporary learning environment.

The present system comprises a base. The base comprises a pair of opposing lateral rails affixed together via a plurality of base supports. A chair comprising a chair platform is pivotally affixed to a pair of chair supports. Each chair support of the pair of chair supports is pivotally connected to a first end of each opposing lateral rail. A desk comprising a desk platform is pivotally affixed to a pair of distal ends of a pair of desk supports. Each desk support of the pair of desk supports is pivotally connected to a second end of each opposing lateral rail. A plurality of notches is disposed on a top edge of the pair of opposing lateral rails. A desk security rod disposed on a pair of proximal ends of the pair of desk supports. The desk security rod is dimensioned to rest within a pair of notches of the plurality of notches.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
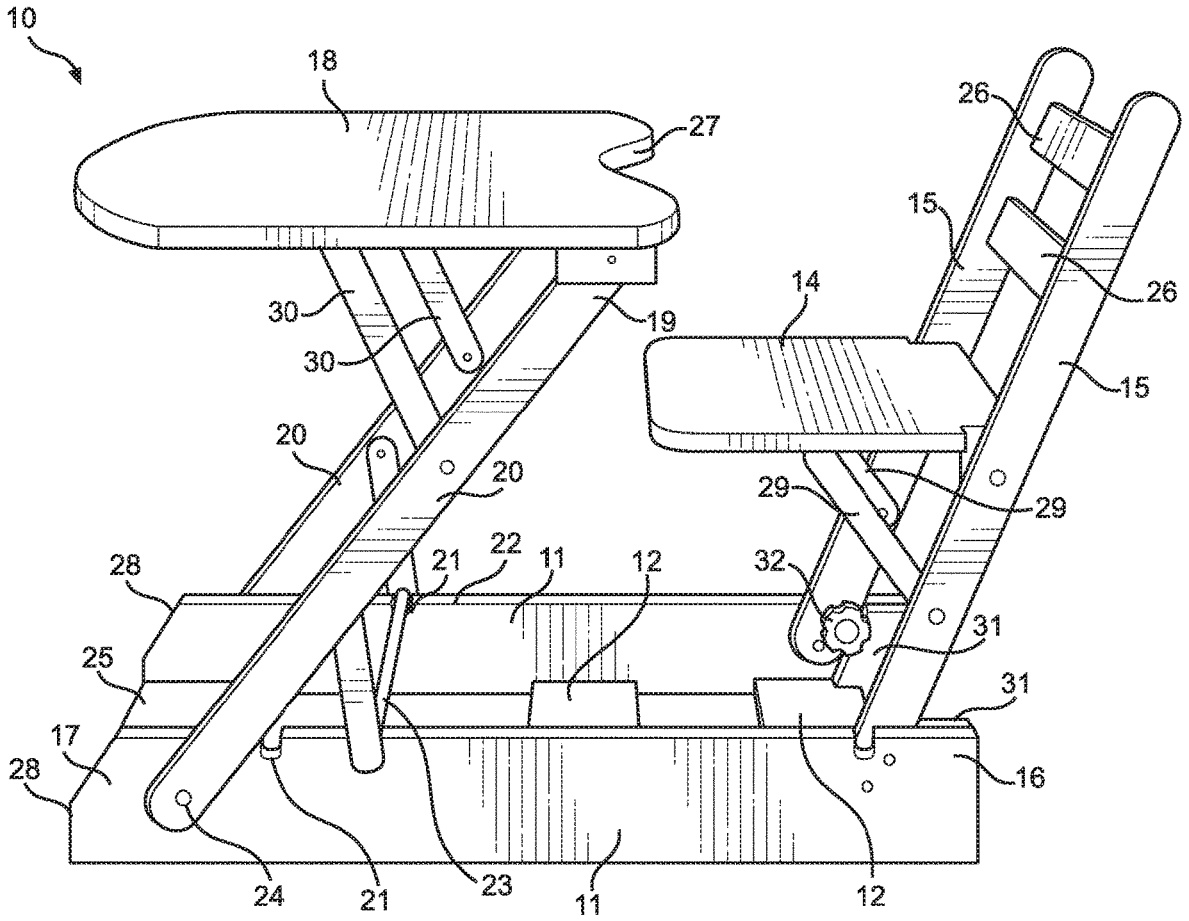
FIG. 1 shows a perspective view of an embodiment of the folding desk and chair apparatus in the deployed position.

Reference is made herein to the attached drawings. Like reference numerals are used throughout the drawings to depict like or similar elements of the folding desk and chair apparatus. The figures are intended for representative purposes only and should not be considered to be limiting in any respect.

Referring now to FIG. 1, there is shown a perspective view of an embodiment of the folding desk and chair apparatus in the deployed position. The folding desk and chair apparatus 10 comprises a base. The base comprises a pair of opposing lateral rails 11. The pair of opposing lateral rails 11 each extends from a first end 16 to a second end 17. The pair of opposing lateral rails 11 are in parallel alignment with each other and are affixed together via a plurality of base supports 12. In one embodiment, a base support of the plurality of base supports 12 defines a handle 25. The handle 25 provides convenience to a user wherein the user can more easily transport the folding desk and chair apparatus 10 when in the stored position. In another embodiment, the pair of opposing lateral rails 11 comprise a pair of cut outs 28 on a top pair of corners of the second end 17 of the pair of opposing lateral rails 11. As such, the risk of harm to a foot of a user is reduced as the corner is blunted. Additionally, in a further embodiment, the pair of opposing lateral rails 11 comprise a pair of cut outs on a bottom pair of corners of the first end 16 of the pair of opposing lateral rails 11. As such, the folding desk and chair apparatus 10 can be tilted backward to assist the user when placing the folding desk and chair apparatus 10 into the folded configuration.

The folding desk and chair apparatus 10 further comprises a chair. The chair comprises a chair platform 14. The chair platform 14 is pivotally affixed to a pair of chair supports 15. Each chair support of the pair of chair supports 15 is pivotally connected to the first end 16 of each of the pair of opposing lateral rails 11. In one embodiment, the chair further comprises a back rest extending upwardly from the chair platform 14. The back rest is defined by a pair of back supports 26 transversally disposed between the pair of chair supports 15. As such, the user is provided with a back rest to lean against when seated in the chair. In the illustrated embodiment, the chair further comprises a pair of secondary chair supports 29. The pair of secondary chair supports 29 are connected to a bottom face of the chair platform 14 on one end and are hingedly connected to a lower portion of each of the pair of chair supports 15.

Additionally, the folding desk and chair apparatus further comprises a desk. The desk comprises a desk platform 18. The desk platform 18 is pivotally attached at a pair of distal ends 19 of a pair of desk supports 20. Each desk support of the pair of desk supports 20 is pivotally attached to the second end 17 of each of the pair of opposing lateral rails 11. In the illustrated embodiment, the desk platform 18 comprises a rounded cut out 27. As such, an individual sitting in the chair is provided with greater space and more comfort. In the illustrated embodiment, the desk further comprises a pair of secondary desk supports 30. The pair of secondary desk supports 30 are connected to a bottom face of the desk platform 18 on one end and are hingedly connected to each of the pair of desk supports 30.

A plurality of notches 21 are disposed in a top edge 22 of the pair of opposing lateral rails 11. A desk security rod 23 is disposed on a pair of proximal ends 24 of the pair of desk supports 20. The desk security rod 23 is dimensioned to rest within a pair of opposing notches defined by the plurality of notches 21. In the illustrated embodiment, the desk security rod 23 is cylindrical and the plurality of notches 21 is each rounded, such that the desk security rod 23 can fit into the notches of the plurality of notches 21. The desk security rod 23 maintains the desk in a desired raised position, adjustable by moving the desk security rod 23 along the plurality of notches 21.

The deployed position is defined, in the illustrated embodiment, by the pair of chair supports 15 and the pair of desk supports 20 being in a first substantially parallel alignment. Furthermore, in the illustrated embodiment, the opposing lateral rails 11, the chair platform 14 and the desk platform 18 are in a second substantially parallel alignment. Additionally, the deployed position is further defined where the pair of secondary chair supports 29 and the pair of secondary desk supports 30 are in a third substantially parallel alignment. As such, the force is supplied to keep the folding desk and chair apparatus 10 not only in an upright and usable position, but also to support the weight of an individual, such as a child, on the chair platform 14 and learning materials, such as books, on the desk platform 18.

In the illustrated embodiment, the pair of opposing lateral rails 11 further comprise a chair stop 31 disposed on the first end 16 thereof. The chair stops 31 are configured to provide a stop by which the pair of chair supports 15 can not extend beyond. As such, convenience is provided to the user in that the chair will not extend beyond a stable point defined by the position of the chair stops 31.

In a further embodiment, the pair of chair supports 15 comprise a knob 32. The knob 32 is configured to secure the positioning of the pair of chair supports 15 in a desired vertical position. As such, convenience is provided to the user, in that the chair can be adjusted to a comfortable position.

Figure 2:
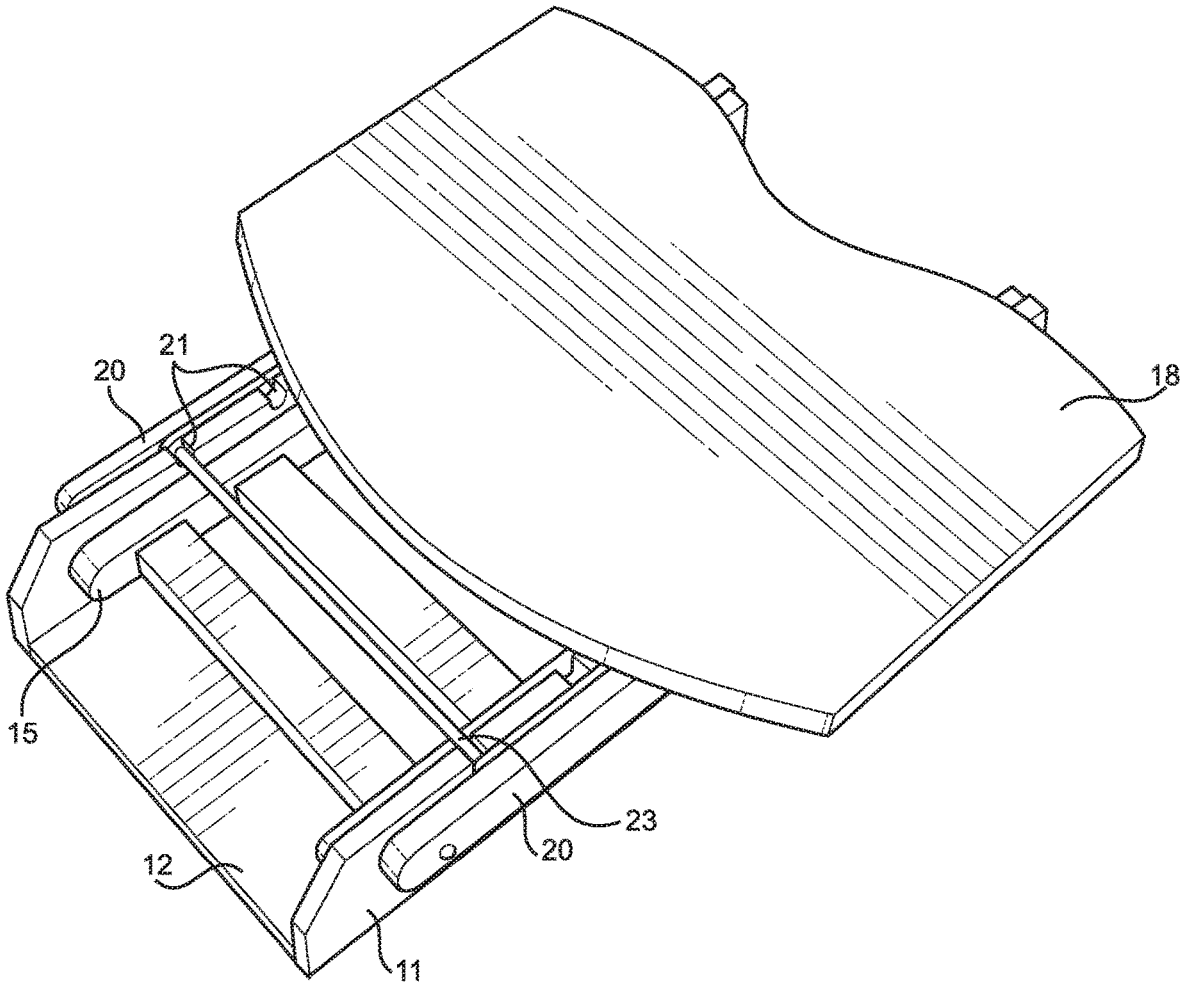
FIG. 2 shows a perspective view of an embodiment of the folding desk and chair apparatus in the stored position.

Referring now to FIG. 2, there is shown a perspective view of an embodiment of the folding desk and chair apparatus in the stored position. In the illustrated embodiment, the deployed position is defined where the opposing lateral rails 11, the pair of chair supports 15 and the pair of desk supports 20, the desk platform 18 and the chair platform are in parallel alignment. As such, the folding desk and chair apparatus can lay flat upon a surface for storage, as well as to make easier to carry.

Furthermore, in the illustrated embodiment, a plurality of notches 21 are shown to be provided at different intervals. As such, the desk security rod 23 can be variably adjusted, such that the desk platform 18 can be provided at variable angles and can be used for various tasks, such as writing or drawing.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A folding desk and chair apparatus, comprising:

a base;

the base comprising a pair of opposing lateral rails affixed together via a plurality of base supports;

a chair comprising a chair platform pivotally affixed to a pair of chair supports;

each chair support of the pair of chair supports pivotally connected to a first end of each opposing lateral rail;

a desk comprising a desk platform pivotally affixed to a pair of distal ends of a pair of desk supports;

each desk support of the pair of desk supports pivotally connected to a second end of each opposing lateral rail;

a plurality of notches disposed on a top edge of each of the pair of opposing lateral rails;

a desk security rod disposed on a pair of proximal ends of the pair of desk supports;

the desk security rod dimensioned to rest within a pair of notches of the plurality of notches.

2. The folding desk and chair apparatus of claim 1, wherein a handle is disposed on a base support of the plurality of base supports.

3. The folding desk and chair apparatus of claim 1, wherein the chair further comprises a back rest extending upwardly therefrom formed by a pair of back supports disposed between the pair of chair supports.

4. The folding desk and chair apparatus of claim 1, wherein the desk platform comprises a rounded cut out.

5. The folding desk and chair apparatus of claim 1, wherein a pair of cutouts are disposed on a top pair of corners of the second end of the pair of opposing lateral rails.

6. The folding desk and chair apparatus of claim 1, wherein the chair further comprises a pair of secondary chair supports hingedly connected to the bottom side of the chair platform and a lower portion of each of the pair of chair supports.

7. The folding desk and chair apparatus of claim 1, wherein the desk further comprises a pair of secondary desk supports hingedly connected to a bottom side of the desk platform and each of the pair of desk supports.

8. A folding desk and chair apparatus, comprising:

a base;

the base comprising a pair of opposing lateral rails affixed together via a plurality of base supports;

a chair comprising a chair platform pivotally affixed to a pair of chair supports;

each chair support of the pair of chair supports pivotally connected to a first end of each opposing lateral rail;

a desk comprising a desk platform pivotally affixed to a pair of distal ends of a pair of desk supports;

each desk support of the pair of desk supports pivotally connected to a second end of each opposing lateral rail;

a plurality of notches disposed on a top edge of each of the pair of opposing lateral rails;

a desk security rod disposed on a pair of proximal ends of the pair of desk supports;

the desk security rod dimensioned to rest within a pair of notches of the plurality of notches;

the folding desk and chair apparatus being movable between a storage configuration and a deployment configuration;

the storage configuration defined where the opposing lateral rails, the chair platform, the pair of chair supports, the desk platform and the pair of desk supports are in parallel alignment;

the deployed position defined where the opposing lateral rails, the chair platform and the desk platform are in a first substantially parallel alignment and the pair of chair supports and the pair of desk supports are in a second substantially parallel alignment.

9. The folding desk and chair apparatus of claim 8, wherein a handle is disposed on a base support of the plurality of base supports.

10. The folding desk and chair apparatus of claim 8, wherein the chair further comprises a back rest extending upwardly therefrom formed by a pair of back supports disposed between the pair of chair supports.

11. The folding desk and chair apparatus of claim 8, wherein the desk platform comprises a rounded cut out.

12. The folding desk and chair apparatus of claim 8, wherein a pair of cutouts are disposed on a top pair of corners of the second end of the pair of opposing lateral rails.

13. The folding desk and chair apparatus of claim 8, wherein the chair further comprises a pair of secondary chair supports hingedly connected to the bottom side of the chair platform and a lower portion of each of the pair of chair supports.

14. The folding desk and chair apparatus of claim 8, wherein the desk further comprises a pair of secondary desk supports hingedly connected to a bottom side of the desk platform and each of the pair of desk supports.

15. A folding desk and chair apparatus, comprising:

a base;

the base comprising a pair of opposing lateral rails affixed together via a plurality of base supports;

a chair comprising a chair platform pivotally affixed to a pair of chair supports;

each chair support of the pair of chair supports pivotally connected to a first end of each opposing lateral rail;

a pair of secondary chair supports hingedly connected to the bottom side of the chair platform and a lower portion of each of the pair of chair supports a desk comprising a desk platform pivotally affixed to a pair of distal ends of a pair of desk supports;

each desk support of the pair of desk supports pivotally connected to a second end of each opposing lateral rail;

a pair of secondary desk supports hingedly connected to a bottom side of the desk platform and each of the pair of desk supports;

a plurality of notches disposed on a top edge of each of the pair of opposing lateral rails;

a desk security rod disposed on a pair of proximal ends of the pair of desk supports;

the desk security rod dimensioned to rest within a pair of notches of the plurality of notches;

the folding desk and chair apparatus being movable between a storage configuration and a deployment configuration;

the storage configuration defined where the opposing lateral rails, the chair platform, the pair of chair supports, the desk platform and the pair of desk supports are in parallel alignment;

the deployed position defined where the opposing lateral rails, the chair platform and the desk platform are in a first substantially parallel alignment, the pair of chair supports and the pair of desk supports are in a second substantially parallel alignment, and the pair of secondary chair supports and the pair of secondary desk supports are in a third substantially parallel alignment.

16. The folding desk and chair apparatus of claim 15, wherein a handle is disposed on a base support of the plurality of base supports.

17. The folding desk and chair apparatus of claim 15, wherein the chair further comprises a back rest extending upwardly therefrom formed by a pair of back supports disposed between the pair of chair supports.

18. The folding desk and chair apparatus of claim 15, wherein the desk platform comprises a rounded cut out.

19. The folding desk and chair apparatus of claim 15, wherein a pair of cutouts are disposed on a top pair of corners of the second end of the pair of opposing lateral rails.

* * * * *